US009622936B2

(12) United States Patent
Almarales

(10) Patent No.: US 9,622,936 B2
(45) Date of Patent: Apr. 18, 2017

(54) FOOT STRETCHER

(71) Applicant: Footstretcher LLC, Loveland, OH (US)

(72) Inventor: Rodrigo Almarales, Cincinnati, OH (US)

(73) Assignee: Improvedance, Cincinnati, OH (US)

( * ) Notice: Subject to any disclaimer, the term of this patent is extended or adjusted under 35 U.S.C. 154(b) by 3 days.

(21) Appl. No.: 14/277,136

(22) Filed: May 14, 2014

(65) Prior Publication Data

US 2014/0342881 A1 Nov. 20, 2014

Related U.S. Application Data

(60) Provisional application No. 61/823,455, filed on May 15, 2013.

(51) Int. Cl.
*A63B 21/002* (2006.01)
*A63B 23/08* (2006.01)
(Continued)

(52) U.S. Cl.
CPC ..... *A61H 15/0092* (2013.01); *A61H 1/0266* (2013.01); *A61H 2001/027* (2013.01); *A61H 2015/0014* (2013.01); *A61H 2201/0157* (2013.01); *A61H 2201/1253* (2013.01); *A61H 2201/1642* (2013.01); *A61H 2201/1645* (2013.01); *A61H 2205/12* (2013.01); *A61H 2205/125* (2013.01); *A63B 21/4015* (2015.10); *A63B 21/4034* (2015.10); *A63B 21/4039* (2015.10); *A63B 23/10* (2013.01); *A63B 2023/006* (2013.01); *A63B 2244/22* (2013.01)

(58) Field of Classification Search
CPC .... A61H 1/0266; A61H 1/02; A61H 15/0092; A61H 15/00; A61H 2001/027; A61H 2201/1642; A61H 2201/1253; A61H 2201/0157; A61H 2201/1261; A61H 2201/1269; A61H 2201/164; A61H 2203/0431; A61H 2205/12; A61H 7/001; A61H 2201/1645; A61H 2205/10; A61H 2205/106; A61H 2205/125; A63B 21/4015; A63B 2023/006; A63B 21/00178; A63B 21/4011; A63B 21/4034; A63B 21/4039; A63B 23/10; A63B 2244/22
USPC ..... 482/79, 91
See application file for complete search history.

(56) References Cited

U.S. PATENT DOCUMENTS 1,722,866 A * 7/1929 Snyder ..... A61H 15/00 601/121
4,378,007 A * 3/1983 Kachadourian ..... A61H 15/00 482/79
(Continued)

OTHER PUBLICATIONS

International Search Report and Written Opinion dated Sep. 30, 2014 for Application No. PCT/US2014/038062.
(Continued)

*Primary Examiner* — Joshua Lee
(74) *Attorney, Agent, or Firm* — Frost Brown Todd LLC

(57) ABSTRACT

A foot stretcher assembly for stretching a foot includes a foot stretcher and a handle removably secured with the foot stretcher. The foot stretcher includes a sole that is flexible in response to receiving a foot. The foot stretcher assembly can also include a securing feature to maintain the foot relative to the foot stretcher.

15 Claims, 14 Drawing Sheets

(51) Int. Cl.

| | |
|---|---|
| ***A63B 23/10*** | (2006.01) |
| ***A61H 1/00*** | (2006.01) |
| ***A61H 1/02*** | (2006.01) |
| ***A61H 5/00*** | (2006.01) |
| ***A61H 15/00*** | (2006.01) |
| *A63B 21/00* | (2006.01) |
| *A63B 23/00* | (2006.01) |

(56) References Cited

U.S. PATENT DOCUMENTS 4,444,389 A 4/1984 Wrucke
4,712,539 A * 12/1987 Kim ..... A61H 15/0092 601/120
5,131,383 A * 7/1992 Juarez ..... A61H 15/00 601/121
6,027,434 A * 2/2000 Gibbons ..... A61H 1/0237 482/131
6,042,520 A * 3/2000 Cantero ..... A63B 23/10 482/140
6,425,843 B1 * 7/2002 Storfer ..... A63B 23/085 482/100
6,966,883 B2 * 11/2005 Pidcock ..... A61H 15/00 601/123
8,262,593 B2 * 9/2012 Pidcock ..... A61H 15/00 601/123
8,808,208 B2 8/2014 Mouatt
2010/0145243 A1 * 6/2010 Kantor ..... A61H 15/00 601/118
2012/0040808 A1 * 2/2012 Khademi ..... A63B 21/00043 482/124
2012/0130292 A1 5/2012 Benjoar
2013/0023807 A1 * 1/2013 Hennessey ..... A61H 7/003 601/119
2013/0226052 A1 * 8/2013 Niggemann ..... A61H 7/007 601/118

OTHER PUBLICATIONS

Design U.S. Appl. No. 29/493,636, filed Nov. 25, 2013.
Design U.S. Appl. No. 29/493,675, filed Nov. 25, 2013.
Design U.S. Appl. No. 29/473,668, filed Nov. 25, 2013.
Design U.S. Appl. No. 29/493,678, filed Nov. 25, 2013.

* cited by examiner

FOOT STRETCHER

PRIORITY

This application claims priority to U.S. Provisional Patent Application Ser. No. 61/823,455, entitled "Foot Stretcher," filed on May 15, 2013, the disclosure of which is incorporated by reference herein.

BACKGROUND

For some people, it is desirable to stretch and increase the flexibility of their foot and/or ankle. For example, divers, swimmers, models, gymnasts, dancers, and others may require flexible feet. It can also be desirable to massage the muscles in the foot and/or other major muscle groups. Accordingly, described herein are versions of a foot stretcher assembly that may further be used as a muscle massager.

While a variety of foot stretchers have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
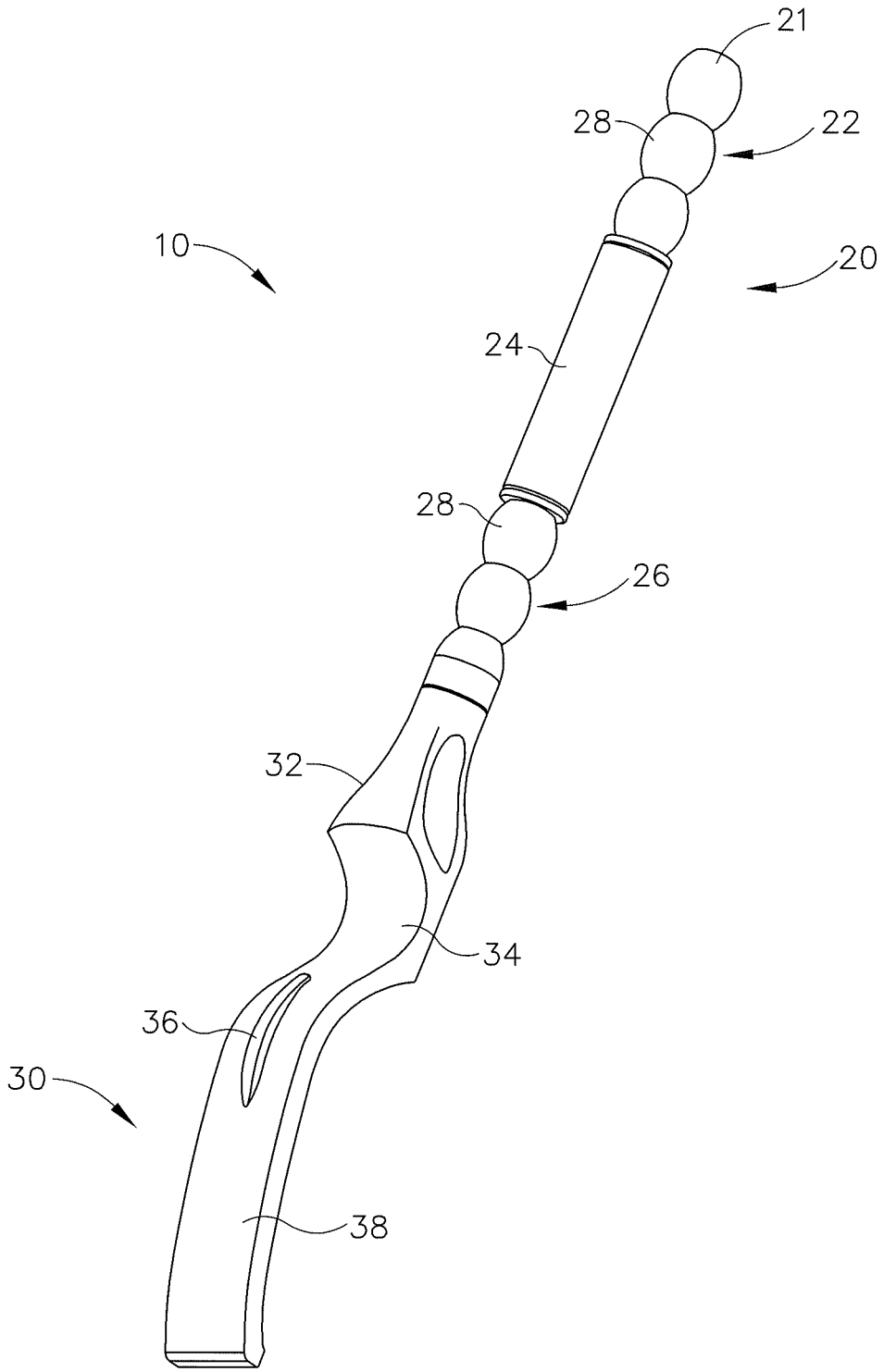
FIG. 1 depicts a perspective view of a foot stretcher assembly.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description, which is by way of illustration, one of the best modes contemplated for carrying out the invention. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

I. Components of a Foot Stretcher Assembly

FIG. 1 illustrates a perspective view of foot stretcher assembly (10). Foot stretcher assembly (10) comprises a handle (20) and a foot stretcher (30). As will be discussed in more detail below, foot stretcher (30) is releasably coupled to end (26) of handle (20).

Figure 2:
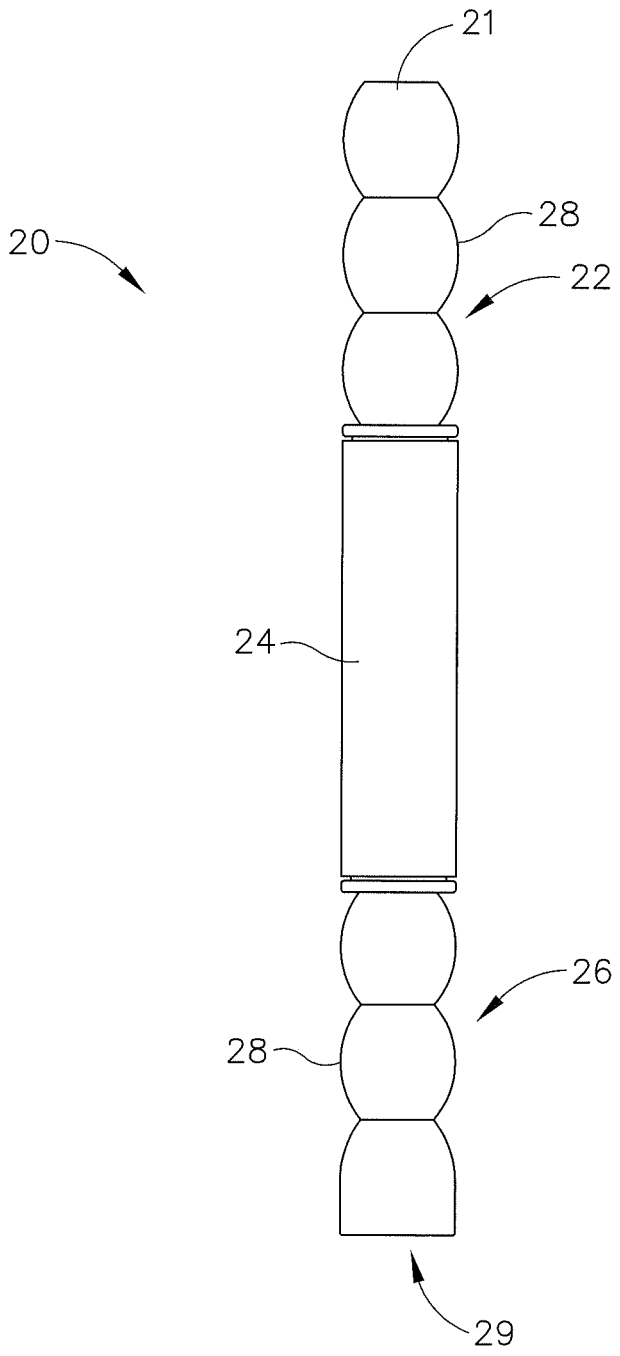
FIG. 2 depicts a side elevational view of a handle of the foot stretcher assembly of FIG. 1.

FIG. 2 shows handle (20) in more detail. Handle (20) comprises a smooth portion (24) positioned between a first end (22) and an opposing second end (26). First end (22) comprises a plurality of knobs (28) and a closed end (21). The present example shows first end (22) comprising three knobs (28), but any other suitable number of knobs (28) can be used. Knobs (28) can be used to grip handle (20) and/or be used to massage the sole of a foot. Accordingly, knobs (28) can align with pressure points located in the longitudinal arch of the foot. This may be where tightness in the foot is typically found. In some versions, knobs (28) are rotatably relative to handle (20). Closed end (21) is shown to include a circular profile such that closed end (21) can further provide a targeted muscle massage by rubbing closed end (21) against a major muscle. Knobs (28) are shown to include a spherical shape and closed end (21) is shown to include a circular profile. Of course, knobs (28) and/or closed end (21) can include other suitable shapes (square, rectangular, oval, etc.). In some versions, closed end (21) protrudes outwardly to continue the spherical shape of knob (28). In other versions, closed end (21) and/or knobs (28) are omitted such that first end (22) is smooth. Other suitable configurations for first end (22) will be apparent to one with ordinary skill in the art in view of the teachings herein.

Handle (20) further comprises a smooth portion (24). Smooth portion (24) comprises a tube and may further include a padded roller positioned over the tube such that padded roller is rotatable relative to the tube. The padded roller may be made of foam, but other suitable materials can be used to provide a cushion for smooth portion (24). Smooth portion (24) can therefore be used to massage the muscles of any major muscle group by rolling smooth portion (24) over the muscle group. It should be noted that the padded roller can be omitted such that the tube of smooth portion (24) is rubbed directly against the muscle. FIG. 1 shows smooth portion (24) having a circular profile, but other suitable shapes can be used.

Second end (26) of handle (20) is similar to first end (22), except that in one embodiment second end (26) comprises a threaded opening (29) instead of closed end (21). Threaded opening (29) is configured to releasably receive threaded portion (31) of foot stretcher (30). Accordingly, handle (20) can be used as a handle with foot stretcher (30), or handle (20) can be used separately as a foot roller or a muscle massager for major muscle groups. Handle (20) is sufficiently rigid to provide sufficient pressure for a massage of the foot and/or other major muscle groups. In some versions, handle (20) is configured not to flex. Handle (20) can be made from plastic or other suitable materials. In some versions, smooth portion (24) is omitted such that knobs (28) extend along handle (20). In other versions, knobs (28) are omitted such that smooth portion (24) extends along handle (20). In still other versions, first end (22) and/or second end (26) are smooth, while smooth portion (24) comprises knobs (28). Other suitable configurations for handle (20) will be apparent to one with ordinary skill in the art in view of the teachings herein.

Figure 11:
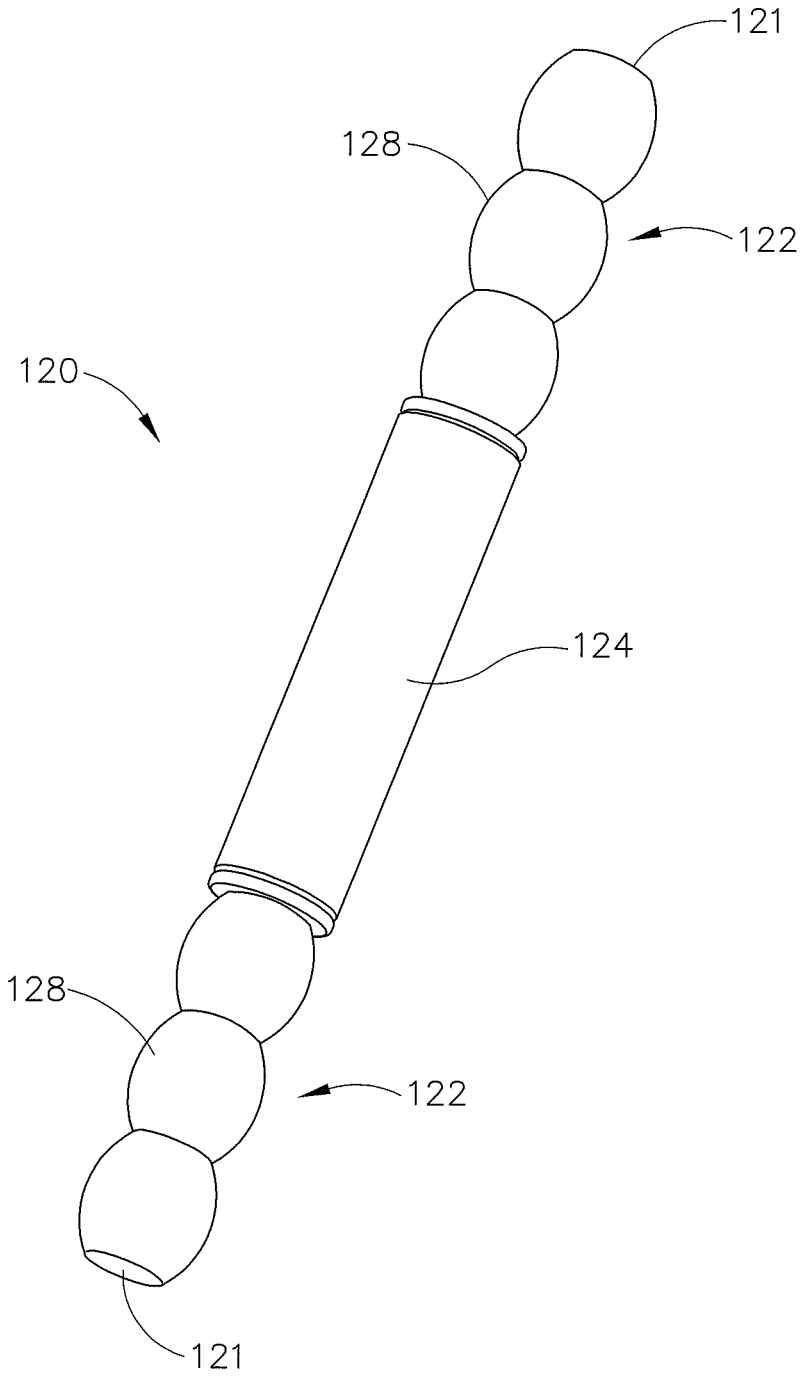
FIG. 11 depicts a perspective view of another embodiment of a handle.

For example, FIG. 11 shows an alternative embodiment of a handle (120). Handle (120) is similar to handle (20), except that handle (120) comprises symmetrical ends (122). Each end (122) comprises a closed end (121), similar to closed end (21). Handle (120) can thereby be used independently to massage the foot and/or any major muscle group. Closed end (121) of the present embodiment comprises a substantially flat circular profile to simulate a user's thumb during targeted massaging of a muscle. Other suitable shapes for closed end (121) will be apparent to one with ordinary skill in the art in view of the teachings herein.

Figure 12:
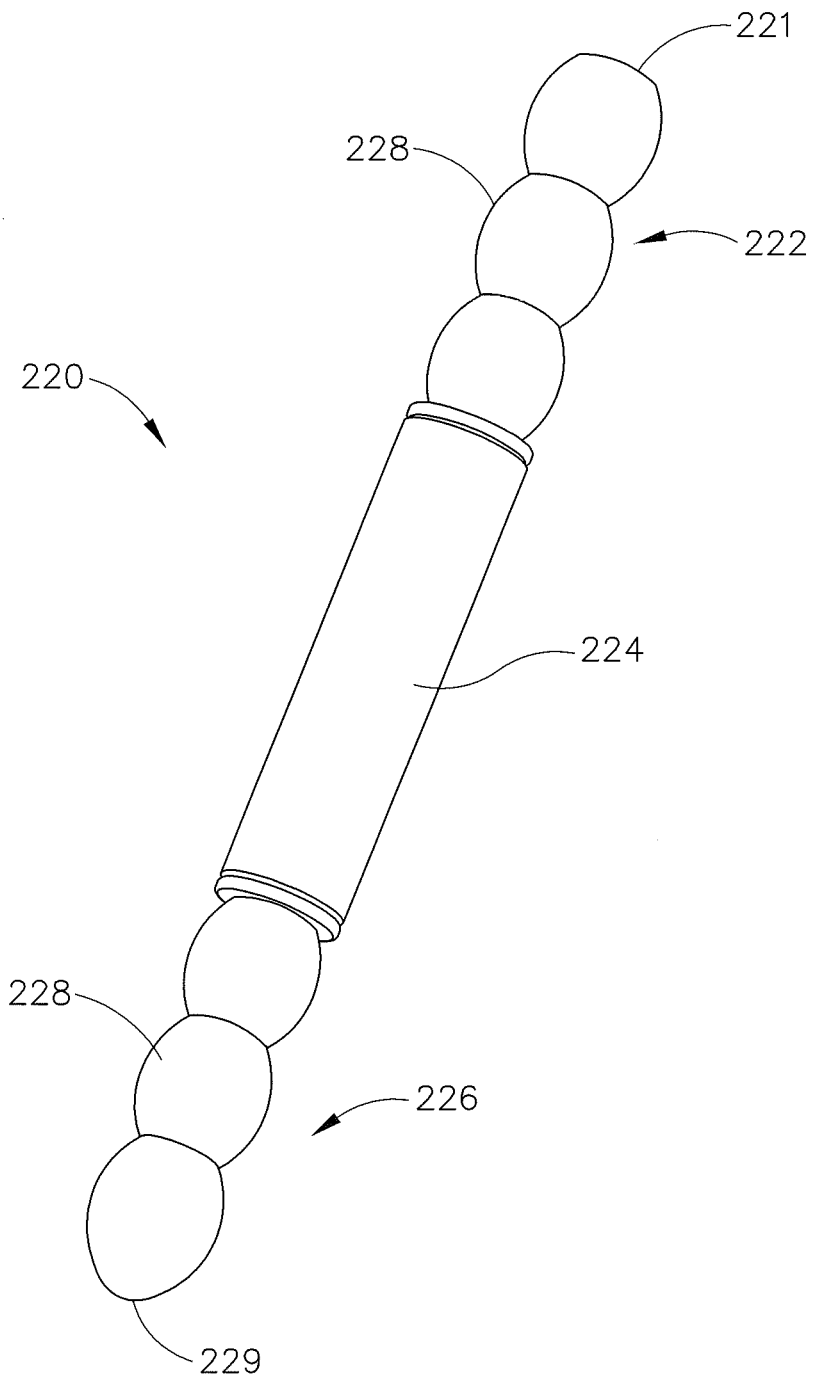
FIG. 12 depicts a perspective view of another embodiment of a handle.

FIG. 12 shows another alternative embodiment of a handle (220). Handle (220) is similar to handle (120) in that handle (220) comprises a smooth portion (224) positioned between a first end (222) having a plurality of knobs (228) and a second end (226) having a plurality of knobs (228). First end (222) comprises a closed end (221) with a substantially flat circular profile similar to closed end (121). Second end (226) comprises a closed end (229) with a spherical profile that extends outwardly from second end (226) to simulate a user's knuckle during targeted massaging of a muscle. Of course, other suitable shapes for closed end (229) will be apparent to one with ordinary skill in the art in view of the teachings herein. In some versions, first and second ends (222, 226) are symmetrical and both comprise a closed end (229) with a spherical profile.

Figure 3:
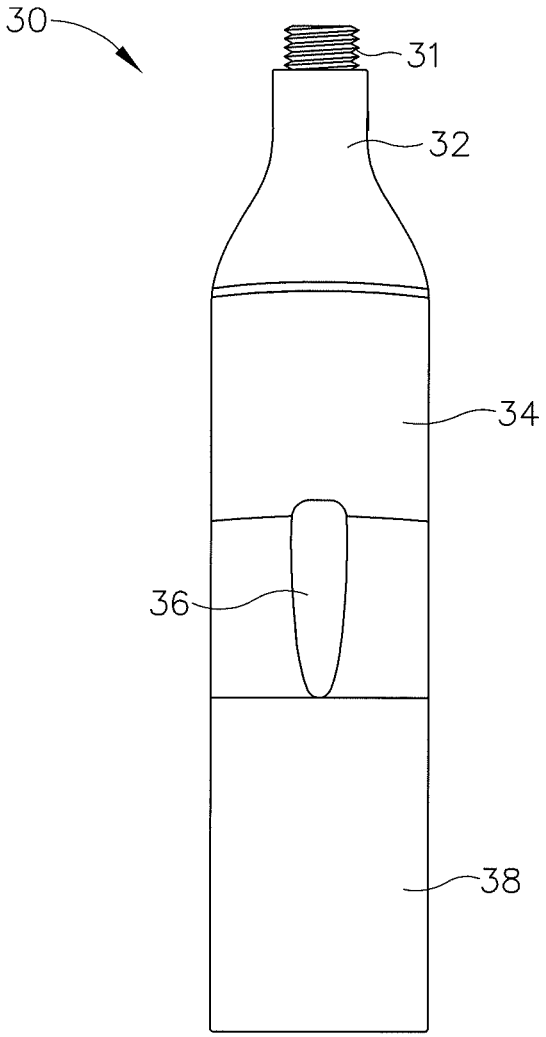
FIG. 3 depicts a front view of a foot stretcher of the foot stretcher assembly of FIG. 1.
Figure 4:
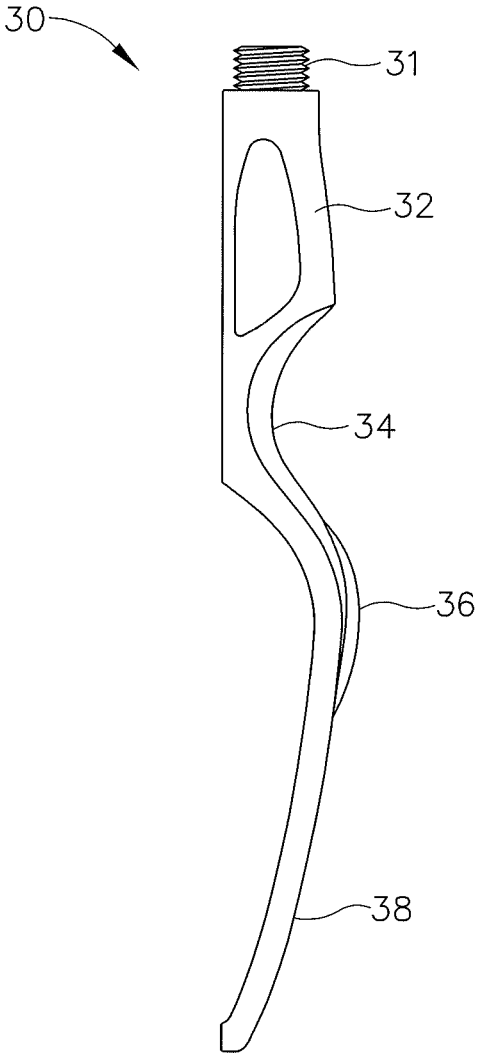
FIG. 4 depicts a side elevational view of the foot stretcher of FIG. 3.

FIGS. 3-4 show foot stretcher (30) comprising a threaded portion (31), an Achilles base (32), a heel base (34), an instep (36), and a sole (38). Threaded portion (31), as discussed above, is configured to insert within threaded opening (29) of handle (20) to releasably couple foot stretcher (30) with handle (20). This allows foot stretcher (30) to be removed from handle (20) for easily transporting foot stretcher assembly (10). Achilles base (32) is configured to align with the Achilles tendon of a user during operation of foot stretcher (30). Achilles base (32) comprises a low profile such that Achilles base (32) does not engage the Achilles area and/or calf muscle of the user during use of foot stretcher (30). For instance, the Achilles area can include the Achilles tendon, the flexor hallicus longus, the peroneal brevis, the peroneal longus, and/or the posterior tibialis. This relieves the Achilles tendon and/or lower calf muscles from any pressure once the leg stretches to prevent discomfort and to allow a more intense stretch on the top of the foot.

Heel base (34) is positioned adjacent to Achilles base (32) and extends inwardly relative to Achilles base (32). Heel base (34) is shaped to receive the heel of a foot. This shape allows foot stretcher (30) to receive both the left and right foot. For instance, the heel of a left foot can be positioned on a right side of heel base (34) and the heel of a right foot can be positioned on a left side of heel base (34). It also positions the foot in a safe and winged position with the toes of the foot pointing outward, which is desired by dancers. Heel base (34) is configured to distract the calcaneus away from the calf, allowing the Achilles tendon to relax, which avoids pressure in the Achilles tendon to prevent injury. As best seen in FIG. 4, instep (36) is positioned adjacent to heel base (34) and is configured to receive an arch of a foot. Instep (36) extends outwardly from a central portion of foot stretcher (30). The shape of instep (36) helps to mold the arch of the foot once maximum stretch is achieved. Prior to achieving a maximum stretch, instep (30) does not impede the foot from being stretched further.

Sole (38) then extends from instep (36) in an arcuate profile to receive the sole of a foot. Sole (38) is slightly flexible to provide a custom stretch for the user. For instance, sole (38) flexes upwardly toward the user's foot for a user with less flexible feet, while sole (38) flexes less as the user's foot becomes more flexible. Sole (38) can be made of a plastic or any other suitable material. Instep (36) supports sole (38) to prevent sole (38) from being too flexible. Sole (38) further works with heel base (34) to release pressure from the heels of the user to prevent impingement and pain in the back of the ankle. Other suitable configurations for foot stretcher (30) will be apparent to one with ordinary skill in the art in view of the teachings herein. Foot stretcher (30) and handle (20) may be made of plastic, such as polycarbonate. The material is of sufficient rigidity to provide stretching of the foot, but resilient enough to provide some flex to accommodate varying levels of user flexibility.

Figure 5:
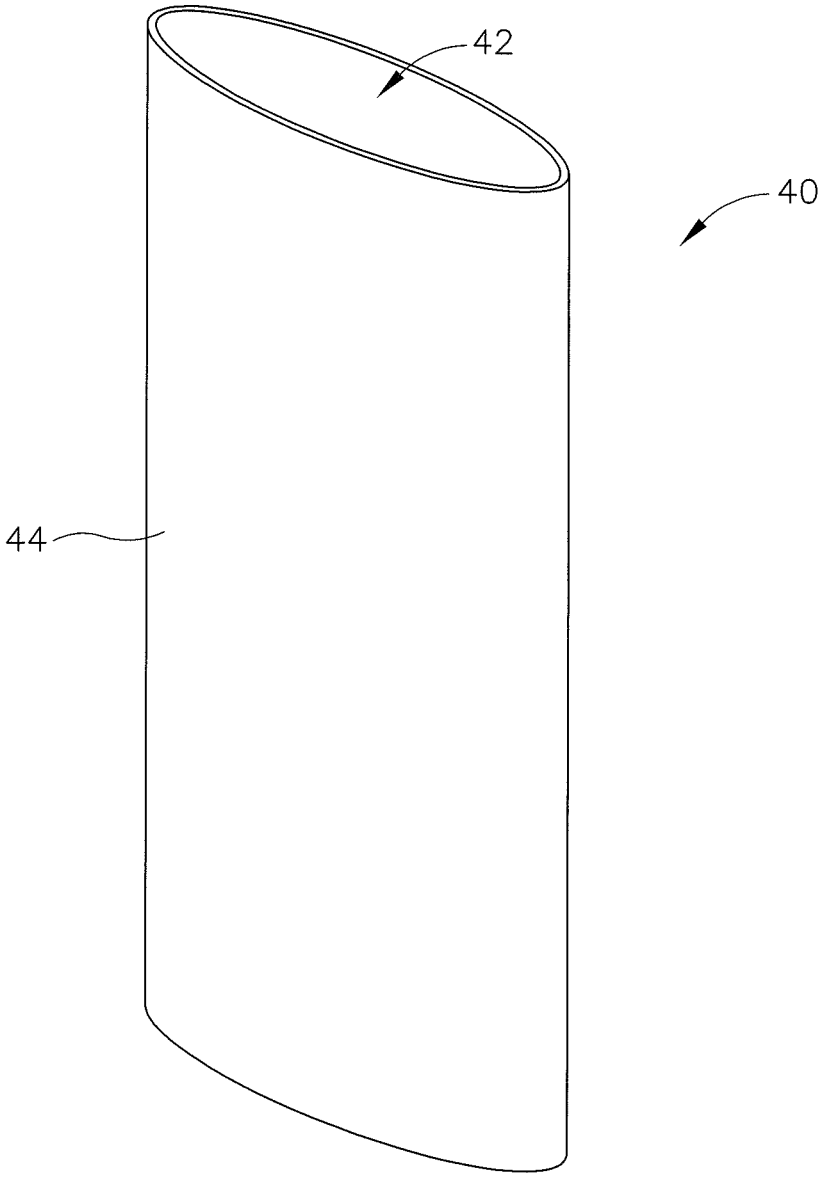
FIG. 5 depicts a perspective view of a stretch band for use with the foot stretcher assembly of FIG. 1.
Figure 6:
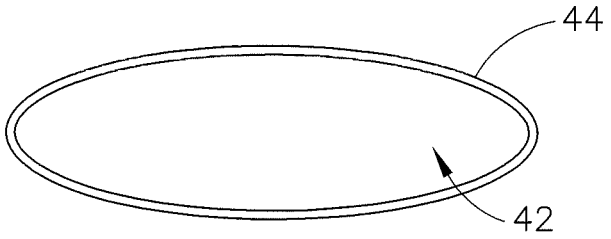
FIG. 6 depicts a top plan view of the stretch band of FIG. 5.
Figure 7:
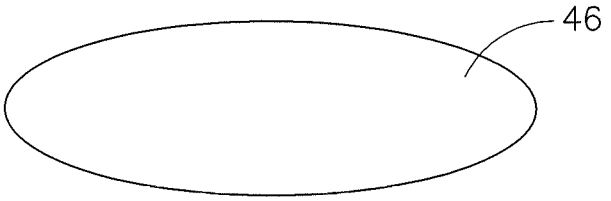
FIG. 7 depicts a bottom plan view of the stretch band of FIG. 5.

As shown in FIGS. 5-7, a stretch band (40) can further be provided for use with foot stretcher assembly (10). Stretch band (40) comprises a sleeve (44) having an opening (42) defined by a first end of sleeve (44). FIG. 7 shows that sleeve (44) comprises a closed end (46) on the opposing end of sleeve (44). However, sleeve (44) may have a second open end. Closed end (46) of the present example comprises an oval profile shaped to correspond to the end of sole (38) of foot stretcher (30). Closed end (46) can include other suitably shaped profiles. Alternatively, the ends of sleeve (44) can be attached such that closed end (46) comprises a tip. Other suitable configurations for closed end (46) will be apparent to one with ordinary skill in the art in view of the teachings herein. Stretch band (40) is configured to be placed over foot stretcher (30) to enclose a foot and foot stretcher (30). Stretch band (40) includes an elastic and slightly flexible material to receive varying types of feet. Stretch band (40) thereby applies uniform pressure throughout the foot being stretched to achieve a stretch from the ankle to the toes of the foot. Stretch band (40) can be made of silicone rubber, among other materials known in the art to be elastic.

In some versions, foot stretcher assembly (10) is provided as a kit. The kit can include foot stretcher assembly (10) with stretch band (40), and a bag for storing foot stretcher assembly (10) in an assembled and/or disassembled state. This may allow for easier transportation of foot stretcher assembly (10). The kit can further include an exercise band and/or instructions for using foot stretcher assembly (10) and/or the exercise band. Such instructions can be provided on a memory stick.

Foot stretcher assembly (10) can be lightweight for easier transportion. Foot stretcher assembly (10) can also be made of a transparent material, a translucent material, and/or an opaque material.

II. Method of Operation

Figure 8A:
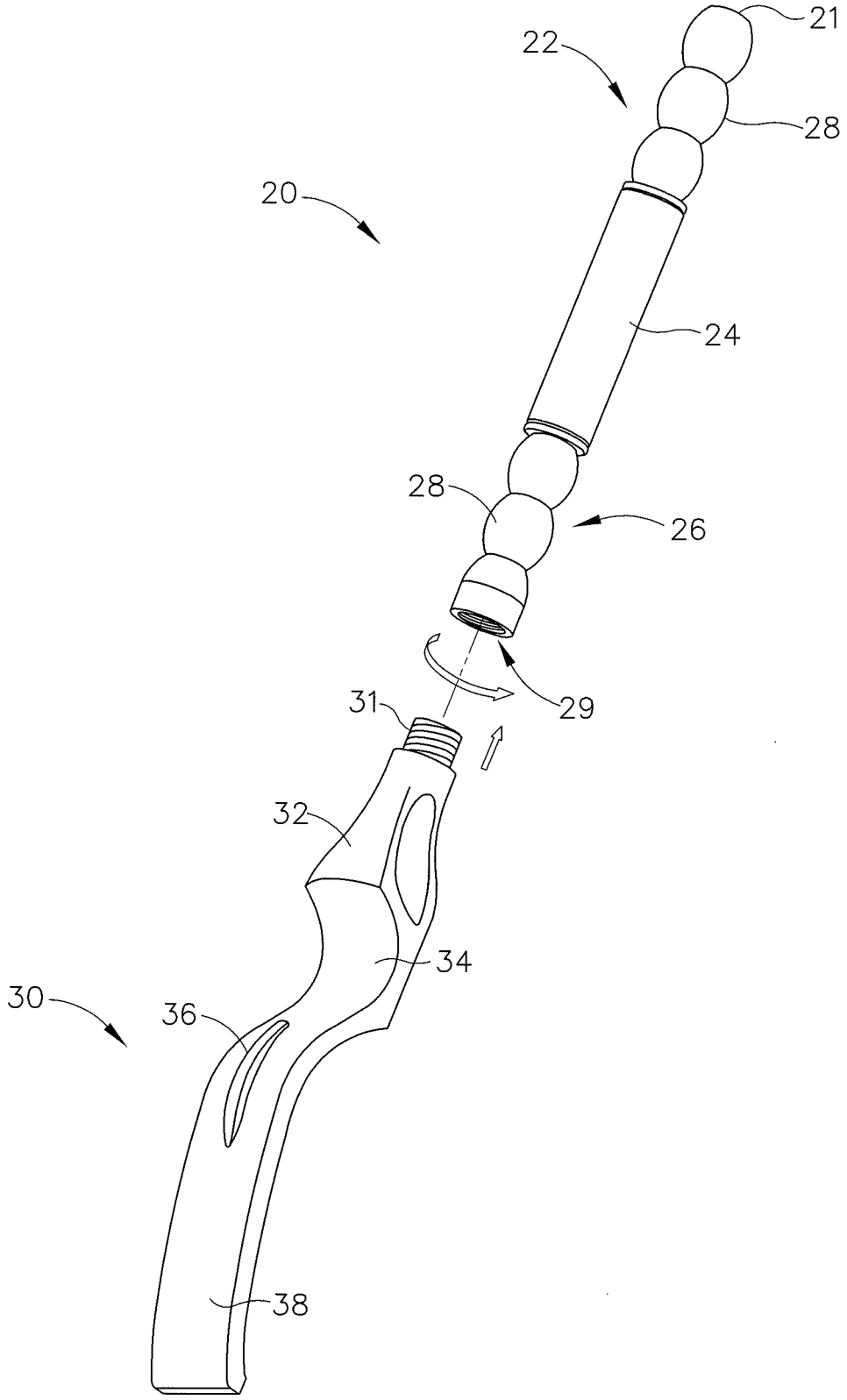
FIG. 8A depicts a perspective view of the foot stretcher being attached to the handle of the foot stretcher assembly of FIG. 1.

FIGS. 8A-8E show a method of operating foot stretcher assembly (10). FIG. 8A shows foot stretcher (30) being coupled with handle (20). To couple foot stretcher (30) and handle (20), threaded portion (31) of foot stretcher (30) is inserted and screwed within threaded opening (29) of handle (20). Alternatively, threaded portion (31) can be provided on handle (20) and threaded opening (29) can be provided on foot stretcher (30). In other versions, the end of foot stretcher (30) is configured to slide within an opening of handle (20) to provide a friction fit between foot stretcher (30) and handle (20). Other suitable methods for releasably coupling foot stretcher (30) with handle (20) will be apparent to one with ordinary skill in the art in view of the teachings herein. Alternatively, handle (20) and foot stretcher (30) can be provided as a unitary component.

Figure 8B:
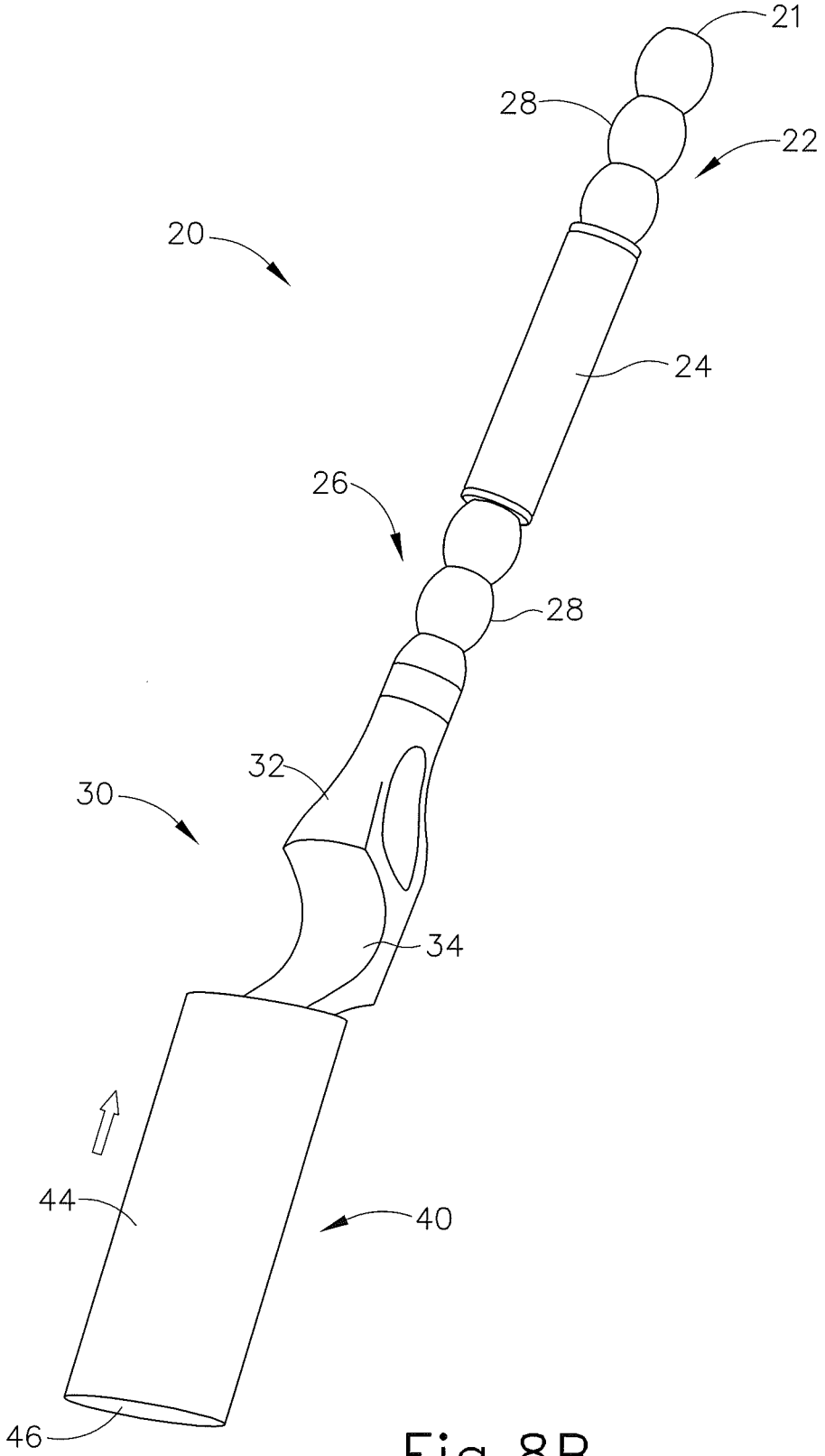
FIG. 8B depicts a perspective view of the stretch band being positioned on the foot stretcher of FIG. 8A.
Figure 8C:
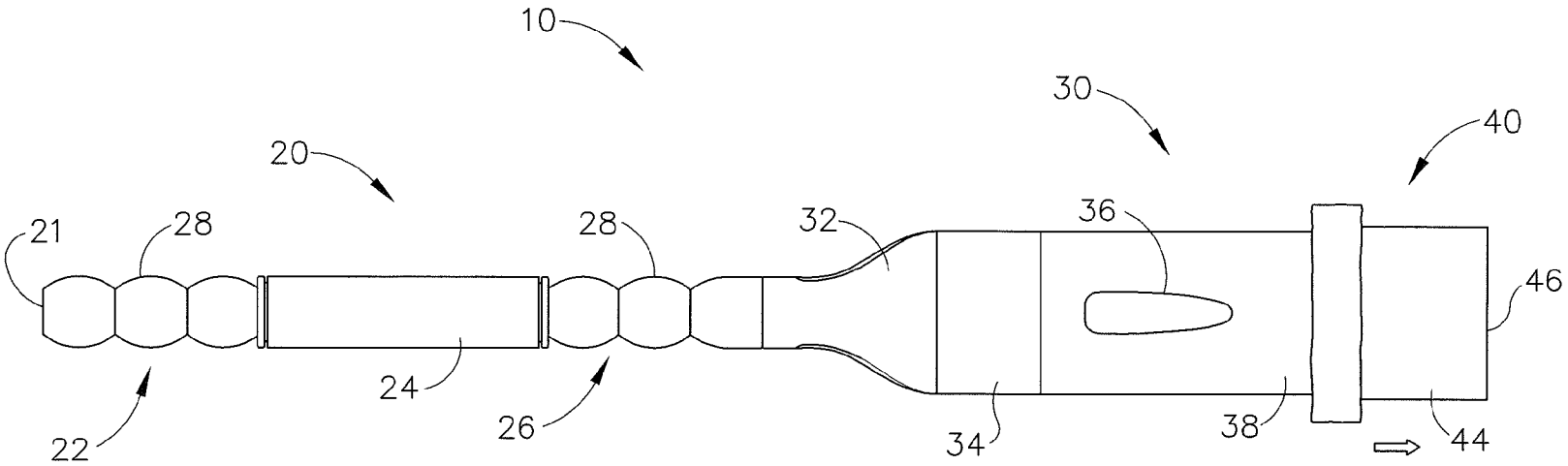
FIG. 8C depicts a front view of the stretch band being rolled around the foot stretcher of FIG. 8A.
Figure 8D:
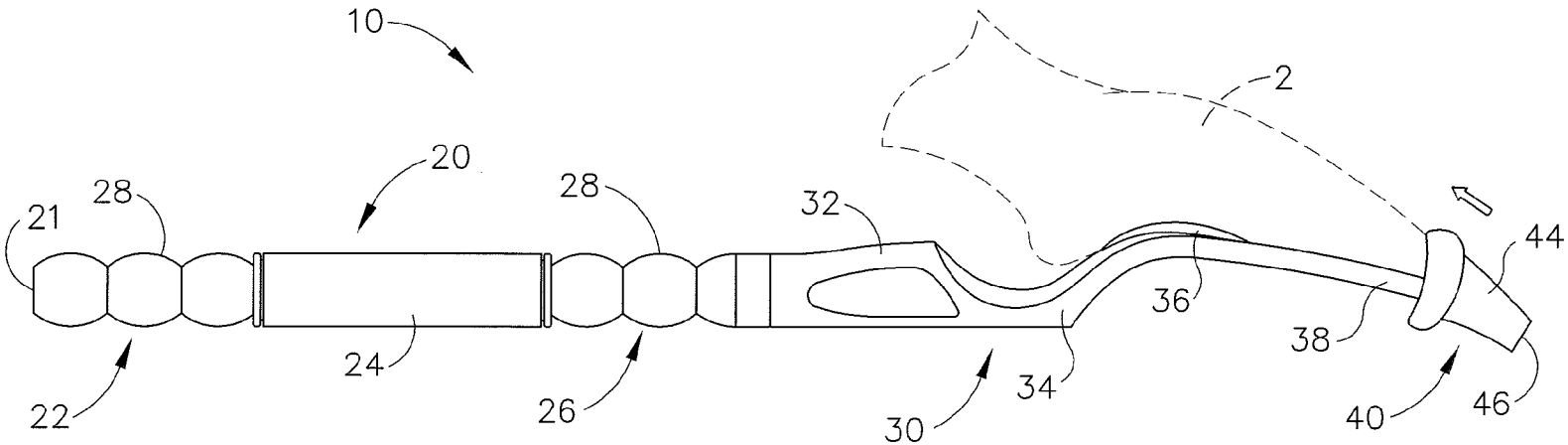
FIG. 8D depicts a side elevational view of a foot being positioned on the foot stretcher of FIG. 8A.

FIG. 8B shows stretch band (40) being slid over foot stretcher (30) until closed end (46) of stretch band (40) contacts sole (38) of foot stretcher (30). This allows stretch band (40) to cover at least a portion of foot stretcher (30). In the present example, stretch band (40) is configured to cover sole (38), instep (36), heel base (34), and at least a portion of Achilles base (38). This allows stretch band (40) to cover a majority of the user's foot to provide a more intense stretch. Of course, other suitable configurations for stretch band (40) will be apparent to one with ordinary skill in the art in view of the teachings herein. Once stretch band (40) is positioned over foot stretcher (30), stretch band (40) is rolled on top of itself toward sole (38) of foot stretcher (30), as shown in FIG. 8C. This allows the user to place his/her foot on foot stretcher (30), as shown in FIG. 8D.

Figure 8E:
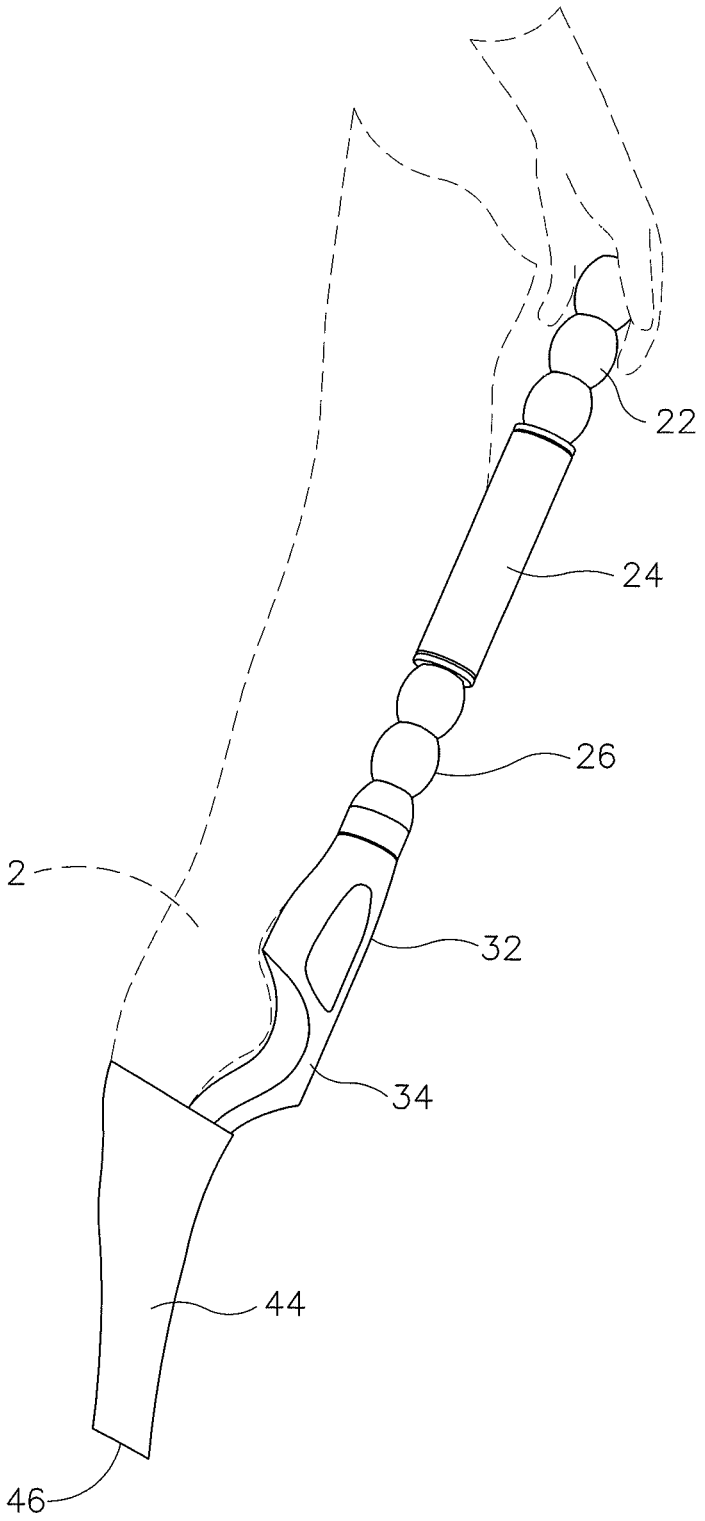
FIG. 8E depicts a perspective view of the foot fully positioned within the foot stretcher of FIG. 8A.
Figure 8F:
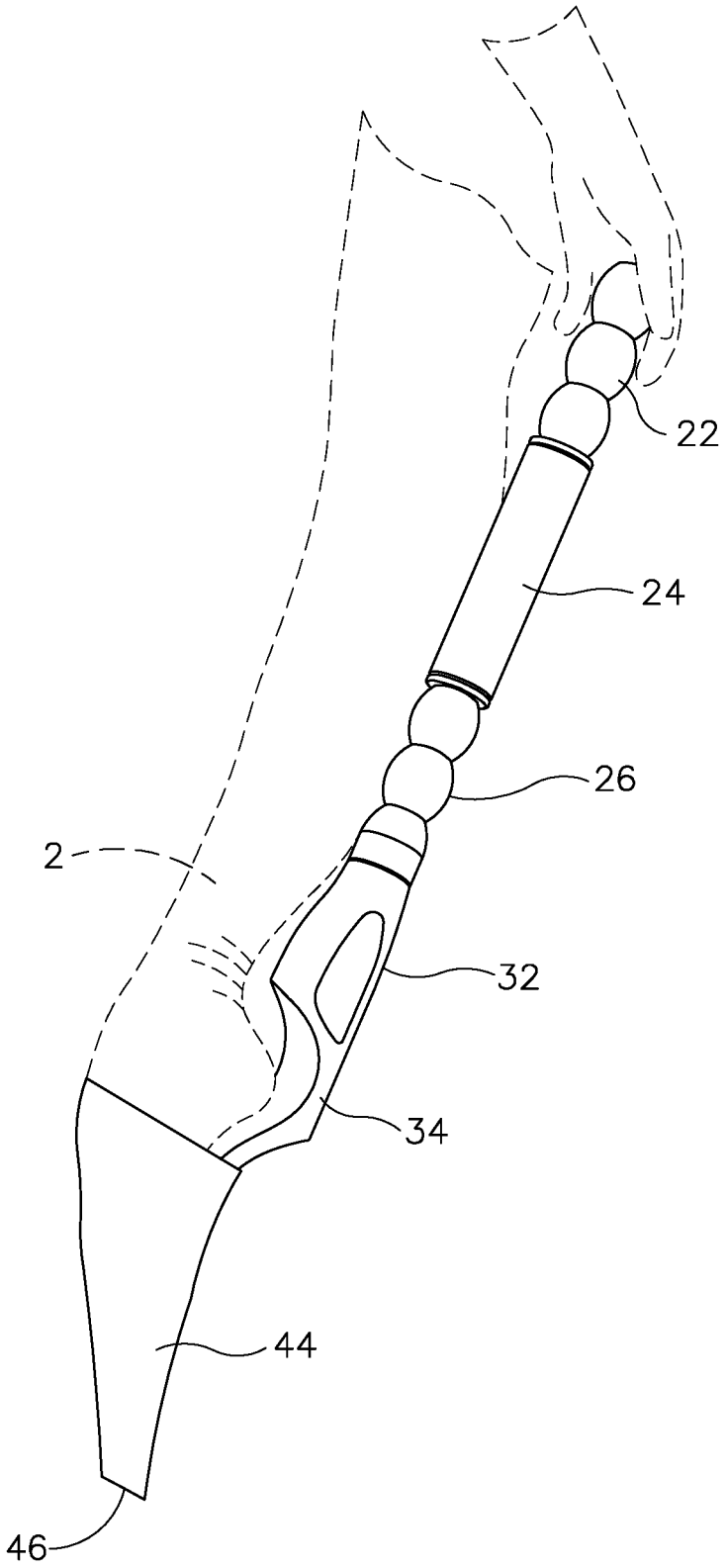
FIG. 8F is a side elevational view of the foot fully positioned within the foot stretcher of FIG. 8A.

With the foot placed on foot stretcher (30), stretch band (40) is configured to receive at least a portion of the user's toes on sole (38). The user's foot is positioned on foot stretcher (30) such that the sole of the foot is positioned on sole (38), the arch of the foot is positioned on instep (36), and the heel of the foot is positioned within heel base (34). Achilles base (32) is positioned adjacent to the Achilles tendon, but Achilles base (32) is configured to provide a gap between Achilles base (32) and the Achilles tendon. Stretch band (40) is then rolled around the user's foot and foot stretcher (30). Stretch band (40) is rolled such that stretch band (40) is extended smoothly over the user's foot and foot stretcher (30) to prevent wrinkles within stretch band (40). The user can then straighten his/her leg while sitting on the floor to stretch the foot within foot stretcher assembly (10), or the user can stretch the foot in a standing position, as shown in FIG. 8E. Handle (20) of foot stretcher assembly (10) can be pulled toward the user's leg to provide a more intense stretch. In some versions, stretch band (40) is merely optional such that a user can stretch the foot with foot stretcher (30) and handle (20).

To remove the foot from foot stretcher assembly (10), stretch band (40) can be rolled toward closed end (46) to release the foot. Foot stretcher (30) can then be removed from handle (20) by rotating foot stretcher (30) relative to handle (20) to unscrew threaded portion (31) from threaded opening (29).

Figure 9:
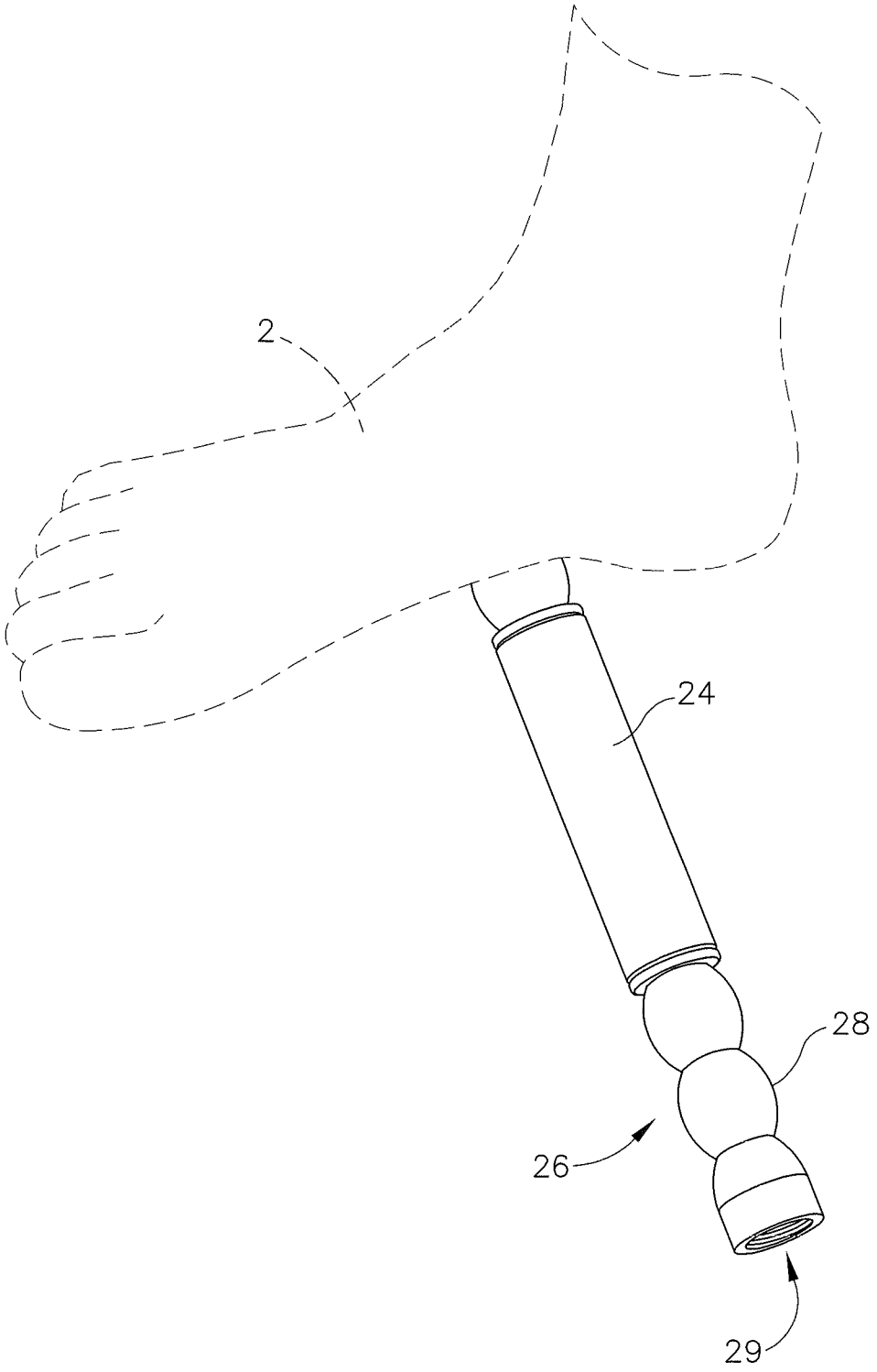
FIG. 9 depicts a perspective view of a foot being massaged by the handle of the foot stretcher assembly of FIG. 1.
Figure 10:
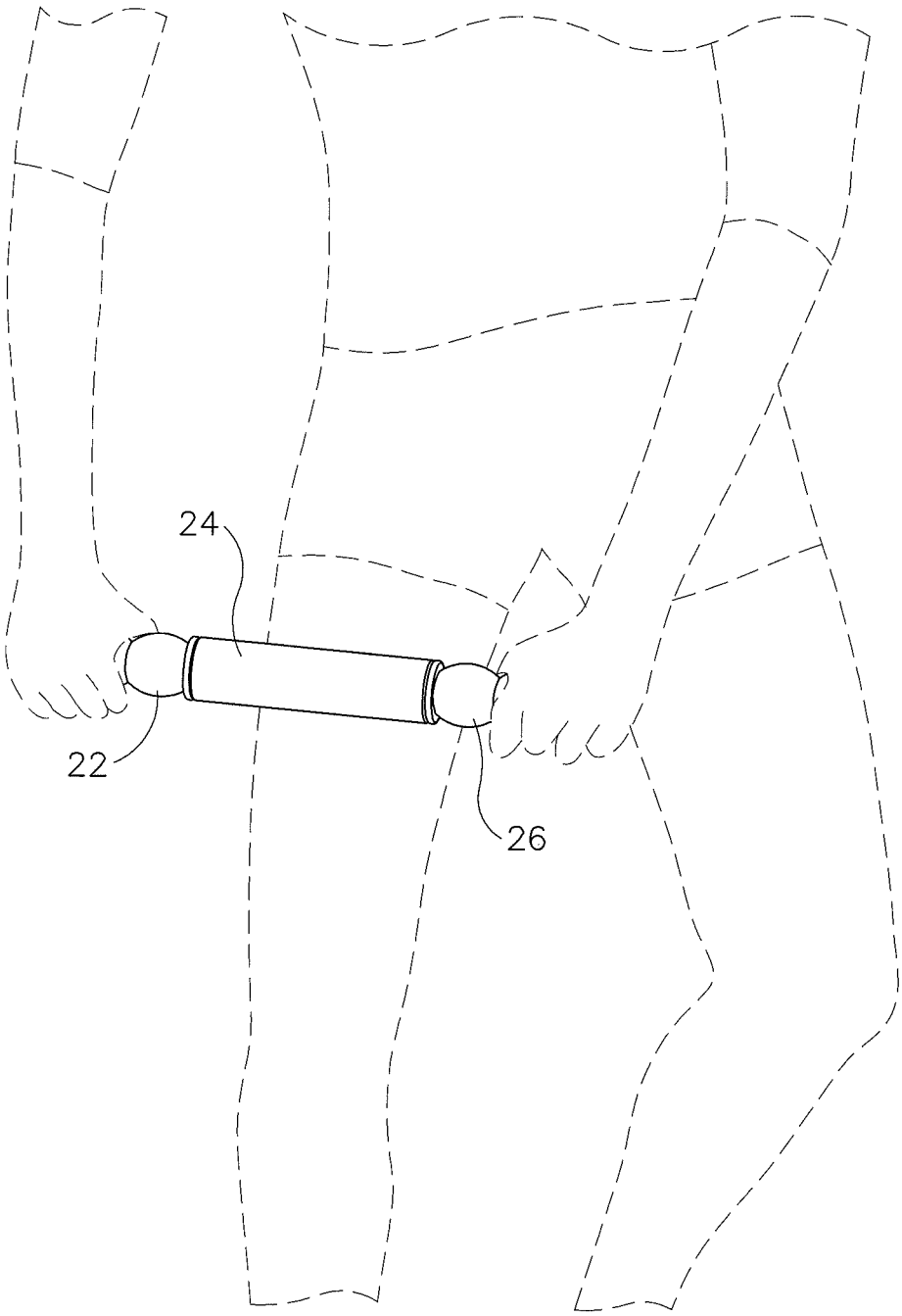
FIG. 10 depicts a perspective view of a muscle being massaged by the handle of the foot stretcher assembly of FIG. 1.

In addition to or instead of stretching a foot, handle (20) can be used to massage the foot and/or major muscle groups. For example, with handle (20) removed from foot stretcher (30), handle (20) can be placed on the ground or other a smooth surface to receive a foot, as shown in FIG. 9. The bottom of the user's foot can be rolled over knobs (28) of handle (20) to massage the bottom of the foot. Accordingly, a user places the bottom of the foot on top of knobs (28) and rolls his/her foot back and forth along knobs (28). Alternatively, the user can grasp first and second ends (22, 26) of handle (20) to roll smooth portion (24) of handle against any major muscle group. FIG. 10 shows a user massaging the quadriceps muscles with handle (20). Accordingly, the user grips first and second ends (22, 26) of handle (20) and places smooth portion (24) against the desired muscle. The user then rolls smooth portion (24) back and forth across the muscle to massage the muscle. While the quadriceps muscles are shown, handle (20) can be used to massage any other suitable major muscle group.

Other methods of massaging the user's muscles will be apparent to one with ordinary skill in the art in view of the teachings herein. For example, the user can place closed end (21) of handle (20) against a muscle to provide a more targeted massage.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometries, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

I claim:

1. A foot stretcher assembly for stretching a foot, wherein the assembly comprises:

a) a foot stretcher comprising a first end comprising a sole having an arcuate profile configured to receive a foot of a user, a central portion comprising a heel base configured to receive a heel of the user, and a second end comprising an Achilles base configured to align with an Achilles tendon of the user, wherein the foot stretcher further comprises an instep extending outwardly from the central portion of the foot stretcher adjacent to the sole, wherein the instep is configured to receive an arch of the foot, wherein the sole is configured to flex upwardly relative to the heel base when an upward force is applied to the sole; and b) a handle removably coupled with the second end of the foot stretcher such that the handle is configured to extend from the foot stretcher.

2. The assembly of claim 1, wherein the handle is threadably coupled with the foot stretcher.

3. The assembly of claim 1, wherein the instep is configured to support the sole of the foot stretcher such that the instep is configured to limit flexing of the sole.

4. The assembly of claim 1, wherein the Achilles base comprises a low profile such that the Achilles base provides a gap between the Achilles base and the Achilles tendon.

5. The assembly of claim 1, wherein the handle comprises a gripping portion grippable by a hand, wherein the gripping portion is configured to be gripped to pull the foot stretcher relative to the foot to thereby stretch the foot.

6. The assembly of claim 1, wherein the handle comprises a plurality of knobs.

7. The assembly of claim 6, wherein the plurality of knobs are configured to massage the foot.

8. The assembly of claim 1, wherein the handle comprises a smooth portion.

9. The assembly of claim 8, wherein the smooth portion is configured to massage a muscle.

10. The assembly of claim 1 further comprising a securing feature removably coupled with the foot stretcher, wherein the securing feature is configured to cover at least a portion of the foot stretcher to maintain the foot relative to the foot stretcher.

11. The assembly of claim 10, wherein the securing feature is elastic.

12. The assembly of claim 10, wherein the securing feature comprises a closed end configured to contact the sole of the foot stretcher.

13. The assembly of claim 10, wherein the securing feature is configured to roll relative to the foot stretcher.

14. The assembly of claim 1 further comprising a bag for storing the foot stretcher and the handle.

15. The assembly of claim 1, wherein the foot stretcher comprises a polycarbonate material.

* * * * *